US005176097A

United States Patent [19]

Bonin et al.

[11] Patent Number: 5,176,097

[45] Date of Patent: Jan. 5, 1993

[54] SELF BAILING BOAT

[76] Inventors: Alfred O. Bonin, Rte. 6, Box 57B, Tylertown, Miss. 39667; Faye Spayde, 116 E. Third St., Long Beach, Miss. 39560

[21] Appl. No.: 736,208

[22] Filed: Jul. 26, 1991

[51] Int. Cl.[5] ..... B63B 13/00

[52] U.S. Cl. ..... 114/183 R; 114/182; 114/197

[58] Field of Search ..... 114/183 R, 184, 185, 114/197, 198, 355, 357, 56, 57

[56] References Cited

U.S. PATENT DOCUMENTS

| | | | |
|---|---|---|---|
| 1,800,556 | 4/1931 | Mead | 114/182 |
| 2,660,142 | 11/1953 | Swenson | 114/182 |
| 3,036,541 | 5/1962 | Musick et al. | 114/197 |
| 3,459,150 | 8/1969 | Lunde | 114/183 R |
| 3,565,031 | 2/1971 | DePersia | 114/197 |
| 4,075,965 | 2/1978 | Lasch | 114/183 R |

*Primary Examiner*—Jesus D. Sotelo

*Assistant Examiner*—Stephen P. Avila

[57] ABSTRACT

A boat has enclosed flotation within a closed bilge or floor of the boat, which is internally raised so that the interior floor of the vessel is slightly above the normal operating water line level of the vessel. The boat has bilge drain valves of a size considerably increased over the one or two square inch drains typified in the prior art. The size of these drain valves is such that, when opened, they represent a significant portion of the transom area being opened to the sea. Spring closure or manual actuation of the valve prevents the ready passage of water into the interior of the boat during heavy waves, especially during following seas which might tend to trigger a flapper operated drain valve. In combination this provides a boat that, if swamped will, even when fully loaded, have sufficient buoyancy to raise itself so that no portion of the bilge is below the water line and with the oversized valves open will have sufficient flow rate that it will rise faster than it can be reswamped.

1 Claim, 4 Drawing Sheets

SELF BAILING BOAT

BACKGROUND OF THE INVENTION

This invention relates to the area of open cockpits, small boats, especially a motorboat.

It is recognized that an open cockpit boat or runabout is highly susceptible to swamping or flooding due to wave action and maneuvering, especially in ocean areas or on large lakes which are subject to the development of waves during storms and the like. Various expedients are known to enable such a boat to cope with a sudden influx of water.

The mechanics of mounting an outboard motor at the rear of a small boat require generally that the transom area be cut away. Additionally, the transom area is generally required to be more or less square, across the beam of the boat. These two features make the transom the most vulnerable area of a small power boat to swamping or wave action. The bow, by contrast, is shaped for easy passage through the water and generally tends to shed waves. It often, due to the distribution of weight in the boat, is also the highest point on the boat.

As a result, one of the prior art methods of reducing the vulnerability of such a boat to swamping is to put a false well at the transom area which is opened to the sea and which, generally catches most of a swamping wave and allows it to drain free; the remainder of the boat, being unswamped, retains residual buoyancy sufficient to lift the boat and permit the transom well to drain.

Other prior art expedients, most notably found in a series of boats typified by the trade name Boston Whaler are to provide some form of closed flotation within the sidewalls of the vessel so as to keep the vessel afloat even in a swamped condition.

However, the quantity of water in the vessel is such that the vessel will still swamp, and while remaining afloat, remains awash, that is the interior of the vessel is filled with more water than can be removed save by pumping. This condition generally will persist so long as the scupper valve or bilge drains are kept submerged by the weight of the water in the cockpit area.

SUMMARY OF THE INVENTION

We have determined that by combining two features within the design of an open cockpit small power boat typified by a runabout or an outboard motor powered skiff, that a vessel may be provided which may always be recovered from swamping without the necessity of external pumping or rescue.

We provide first in the boat enclosed flotation that distribute the flotation by providing a closed bilge or floor of the vessel which is internally raised so that no portion of the interior cockpit area of the vessel is below a line which is slightly above the normal water line level of the fully loaded vessel afloat. In other words, the interior floor of the vessel is slightly above the normal operating water line level of the vessel.

We provide in combination with this bilge drain valves of a size considerably increased over the one or two square inch drains typified in the prior art. Since the size of these drain valves is such that, when opened, they represent a significant portion of the transom area being opened to the sea, we provide in alternative form for a manual rather than an automatic opening of the valve so as to prevent the ready passage of water into the interior of the boat during heavy waves, especially during following seas which might tend to trigger a flapper operated drain valve.

In combination this provides for a boat that, even when fully loaded, if swamped will have sufficient buoyancy to attempt to raise itself so that no portion of the bilge is below the water line and with the oversized valves open will have sufficient flow rate that it will rise faster than it can be reswamped.

Thus, it is an object of the invention to disclose a vessel which when swamped will readily refloat itself without exterior pumping.

It is a further object of the invention to disclose a vessel which when swamped will drain itself with sufficient rapidity that it is unlikely to be reswamped while in an open wash position.

It is a further object of the invention to disclose a construction for an open cockpit vessel which is particularly easy to recover from a swamped or a washed position.

It is a further object of the invention to disclose an open cockpit vessel having much greater safety for operation in open ocean areas or conditions of high sea and waves.

These and other objects of the invention may be more clearly seen from the detailed description of the preferred embodiment which follows.

DETAILED DESCRIPTION OF THE PREFERRED EMBODIMENT

Figure 1:
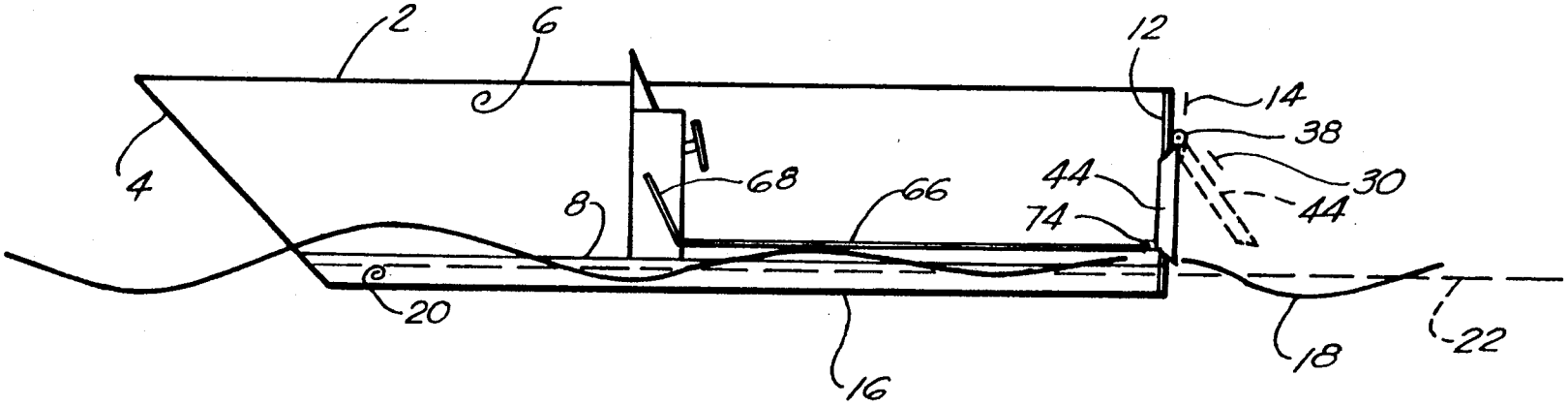
FIG. 1 is a side view of a vessel of the invention.
Figure 2:
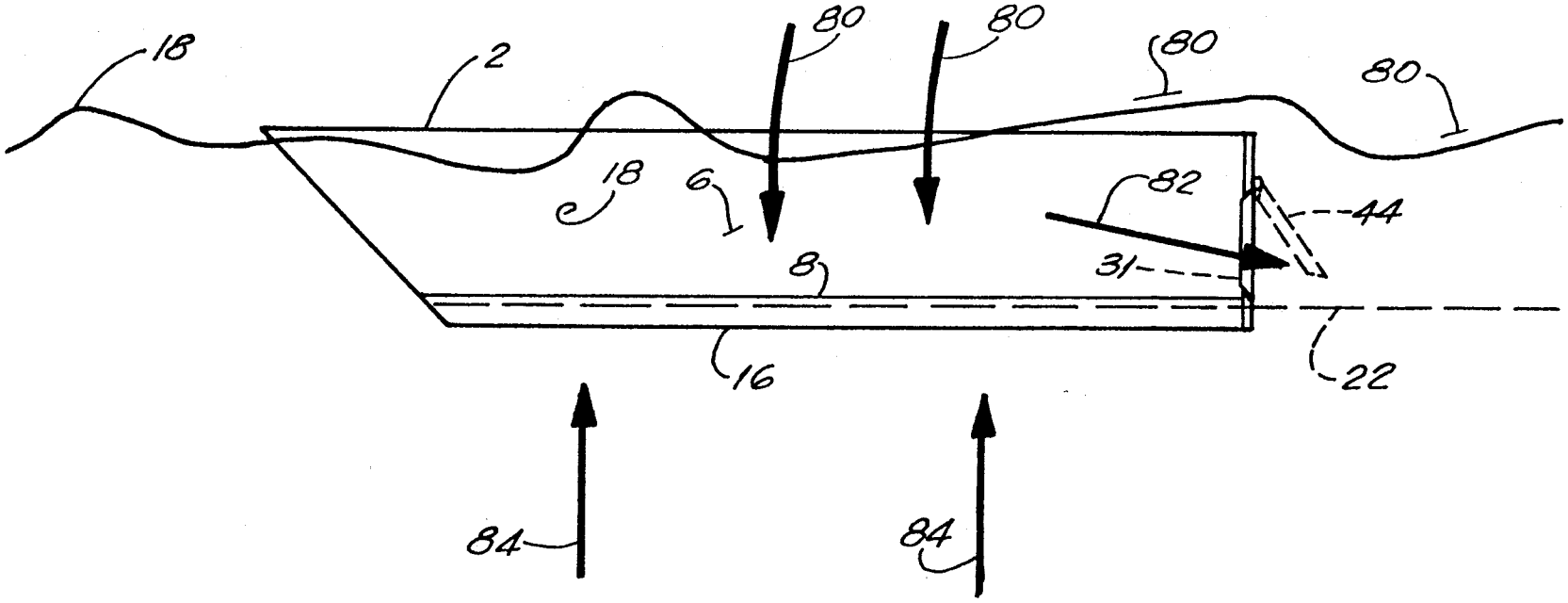
FIG. 2 is a side view of the vessel when swamped.
Figure 3:
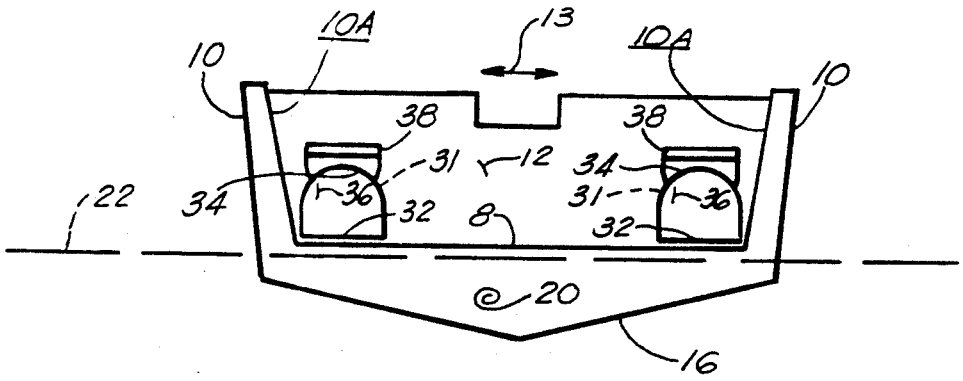
FIG. 3 is a view of the transom of the vessel.
Figure 4:
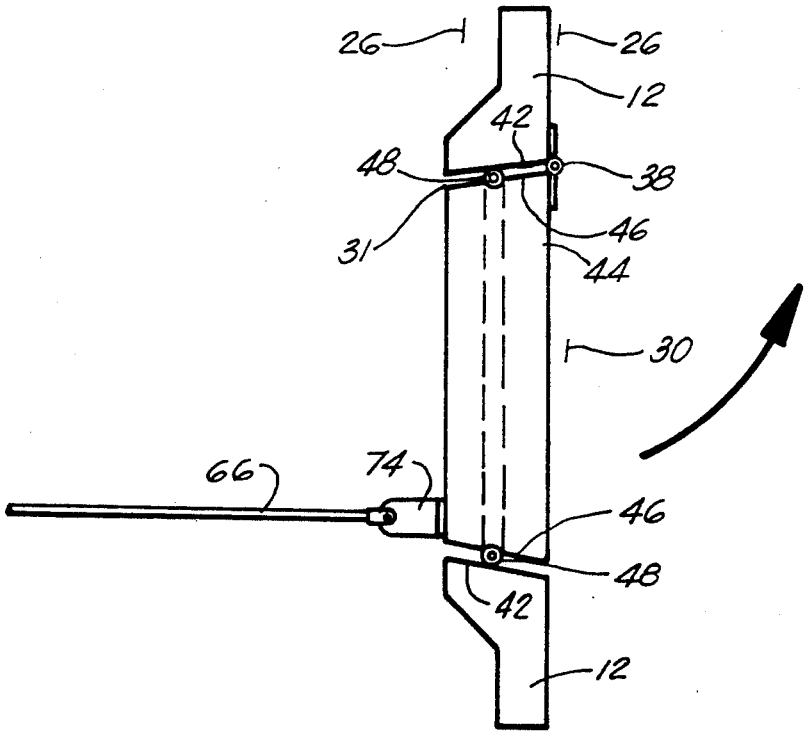
FIG. 4 is a view of one embodiment of the Vslves of the invention.
Figure 5:
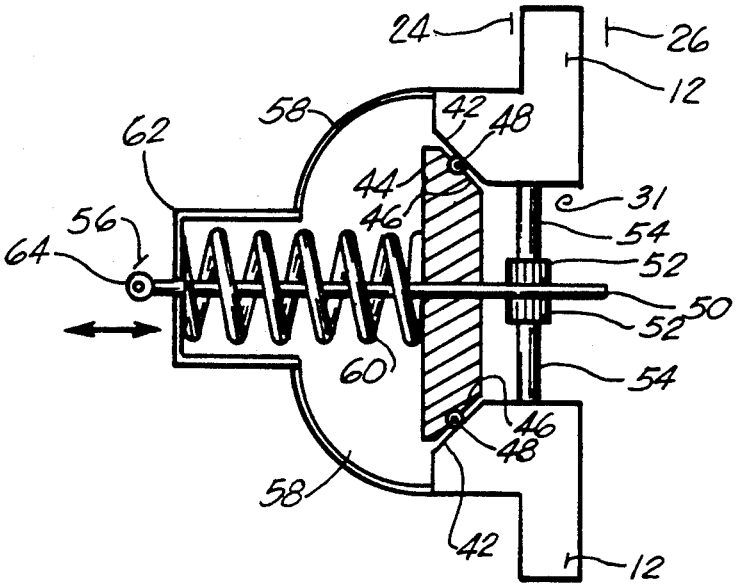
FIG. 5 is a view of another embodiment of the Vslves of the invention.
Figure 6:
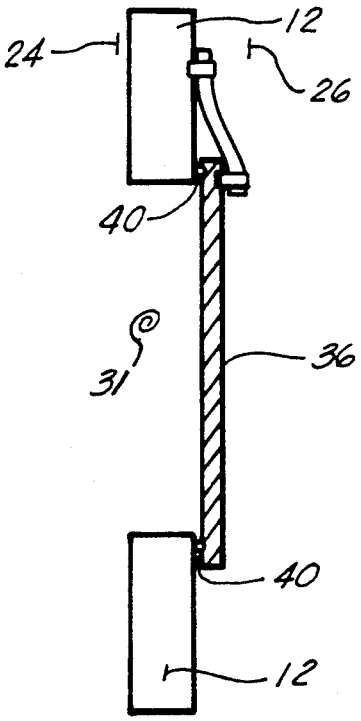
FIG. 6 is a view of a third embodiment of the Vslves of the invention.

We show as a preferred embodiment of the vessel and as a typical example an open cockpit outboard motor powered boat 2 of a size typical for the small runabout ranging in an overall length from 15 to 25 feet.

The vessel as is known comprises a pointed bow section 4, an open cockpit area 6 enclosed by an interior floor 8, enclosed within the sides 10 of the vessel and a relatively square transom 12 extending across the beam 13 of the vessel 2 to form the stern 14.

The exterior of the vessel is shaped to form a suitable hull 16 shape for easy passage to the water 18. The transom 12 may be cut away to receive an outboard motor mount of typical design.

We form the outer hull 16 and the inner floor 8 and walls 10A of two continuous, solid, water impermeable shapes, bonded together and filled with flotation material 20 having a total flotation such that when fully loaded the vessel will float with the interior floor 8 slightly above the displacement water line 22 level of the vessel 2.

Inasmuch as such small vessels 2 are designed for specific loading and rating in terms of pound of working load and maximum size of motor fuel and stores, the quantity of flotation material 20 and location of the floor 8 is determined by a design calculation which can be readily made by one of skill in the art. The design determination of a fully loaded water line level 22 is well known to those of skill in the art of hull design as the overall shape of the outer hull 16 depends upon the chosen displacement level 22 of any vessel or boat 2.

We then provide in the transom 12, in typically two positions, one on each side, permitting mounting of an outboard motor, oversized scupper valves 30 of the inventive combination.

In the first embodiment of the scupper valve 30, we disclose an opening 31 in the transom 12 forming a cockpit drain 32 having a considerably larger cross sectional area than typical prior art drains. The design of the drain valve 30 is also unique.

In a first embodiment, an opening 31 is provided having a flat base 32 located along the line of the cockpit floor 8 and extending for a distance along the transom 12 and then rising in a semicircular arc 34 to form a drain opening 31 having chordal circular shape. On the stern 14 of the vessel on the outside of the transom 12, hanging down over the drain opening 31 is a matching semicircular drain flap 36 hinged at a single point 38 at its top to the transom 12 of the vessel so that it will swing open away from or close over the drain opening 31. The drain flap 36 preferably will contain an interior seal 40 for sealing against the drain opening 31 when in the closed position. The hinge 38 is slightly biased to the closed position, typically by making the hinge 38 out of a continuous piece of elastomeric material which will have a tendency to urge the drain flap 36 to a closed position but not being so strongly sprung as to resist opening of the drain flap 36 under the influence of any interior water pressure.

A first alternative form of the drain comprises a large, regular opening 31, one in each corner of the transom 12 adjacent the meeting of the floor 8 and the interior sides 10A of the boat. This opening 31 may be circular, square, or rectangular. The opening 31 is tapered so that it is slightly larger towards the interior 24 of the boat tapering down towards the exterior 26 of the boat forming thereby a sealing edge 42.

Within the drain opening 31, is mounted a mating plug 44, of the same shape as the drain opening 31, having a mating tapered edge 46 tapering from a larger size on the interior 24 of the boat to a smaller size at the exterior 26 of the boat thus forming a mating edge to edge seal. Additionally, within a groove around the sealing face of the plug is inserted a continuous gasket 48 so as to permit the plug 44 to form a water tight seal into the opening 31. The plug 44 is mounted on a spindle 50 which travels and extends through the opening 31. One end of the spindle 50 is supported within a spindle guide 52 mounted on a thin spider 54 within the otherwise clear drain opening 31. The other, inboard end 56 of the spindle is supported within a spindle cage 58.

A biased spring 60 is provided between the spindle cage 58 and the plug 44 for biasing the plug 44 against the opening 31 into a closed sealed position. This bias spring 60 may be enclosed within a spring houseing 62 within the spindle cage 58.

The inboard end 56 of the spindle is provided with an eye 65 or means of connection to an activating linkage 66 which then travels to a hand actuator 68 or lever mounted adjacent an operating position of the boat.

An alternate form of plug 44 discloses an opening 31, as before, in the transom 12 of the boat, being tapered, having the narrower taper to the interior 24 of the boat and the larger taper to the exterior 26 of the boat. A mating tapered plug 44 is fit within the opening 31 and attached at an upper end by a hinge 72 to the transom 12 of the vessel. Again, the tapered plug 44 is provided with a circumferential groove and gasket 48 for a sealing fit within opening 31.

At a lower end of the tapered plug 44, on the interior side of the tapered plug 44, diametrically across the tapered plug from the point of the hinge 72 attachment, is an actuator attachment 74.

A rigid actuating mechanism 66 capable of both pushing and pulling is attached to the actuator attachment 74 and runs to a lever actuator 68 or similar method of actuation located near the operating position of the boat.

In this latter form of plug 4, inasmuch as there is not a means biasing the plug 44 to a closed position, the actuator linkage 66 must be capable of both a pushing and a pulling force. Thus, either a bar linkage or an enclosed cable such as a teleflex cable would be considered desirable. Whichever linkage is chosen it must be capable of exerting a pushing force against the plug 44 as well as a pulling force to pull the plug 44 closed.

In all three of the embodiments shown, the positive closing force permits a considerably larger drainhole 31 to be placed in the transom 12 than would be acceptable in a vessel having merely a standard scupper valve. This is clear from the consideration of the nature of the process that occurs when the boat swamps. Typically a boat 2 swamps due to waves or repeated wash of water 18. Once the boat 2 is awash, it is exposed to repeated flooding from successive waves 80 which tends overcome any draining 82 through cockpit valves. Further, an open scupper valve may actually induce the initial swamping of the boat 2, inasmuch as a boat of this nature typically swamps across the transom 12 from following waves and would be more susceptible to swamping if it had large open drain valves in its stern 14.

By contrast, in use, the boat 2 of the invention once swamped will have a strong tendency to rise 84 due to the interior flotation 20 until the floor 8 of the vessel is above the displacement water line 22.

Actuation of the valves 30 of the invention, manually or by weight of water, to cause draining, opens a very large drain area, a significant fraction of the overall cross section of the transom 12 typically on the order of two to ten percent of the overall transom 12 cross sectional area. This permits a very high flow rate of drainage 82 to be established thus permitting the boat 2to rapidly rise so that it is successively more resistant to succeeding waves 80. While it will take some water from succeeding waves after the one which swamps the boat 2, the speed of rise which may be obtained by the oversized drain valves 30 will rapidly reduce the vulnerability to swamping with each successive wave 80 until the vessel 2 rises completely free and drains. Inasmuch as no portion of the interior cockpit 6 is below the water line 22 of the vessel in a loaded condition, there is no residual water that has significant weight within the vessel, and the vessel 2 thus becomes completely self-bailing rising to a point of safety.

It can thus be seen that the combination of designing the vessel such that the floor of the vessel is above the design water line under a loaded condition and the providing of actuatable bilge drains having a large cross sectional area significantly enhances the ability of the boat to recover from a swamping condition even in the face of repeated wave action and thus produces a boat which is significantly more resistant to swamping and significantly easier to recover without external assistance from a swamping episode than the vessels of the prior art. Whereas several specific embodiments of the drain valve have been described in some detail, it should be clear that there are numerous expedients in terms of the design of such a plug valve which may be apparent to those of skill in the art. Thus the patent extends beyond the specific valve embodiments disclosed to the more general forms as are inherent in the claims.

I claim:

1. A self-bailing motorboat hull comprising:

an outer hull having a displacement, defining a waterline thereupon;

an inner cockpit floor in all places being above said waterline, the motorboat being in a fully loaded condition;

said outer hull and said floor defining a space therebetween;

said space being filled with a floatation material;

at least one drain interposed within said outer hull, having a lower level at the level of said cockpit floor, and an upper level within the top half of the transom;

said drain having a large cross sectional area which is at least four to ten percent of the overall cross sectional area of the transom.

* * * * *